US006435615B1

(12) United States Patent
Zapf

(10) Patent No.: US 6,435,615 B1
(45) Date of Patent: Aug. 20, 2002

(54) SEATING FURNITURE WITH DOWNWARDLY MOVABLE, PIVOTING BACKREST

(76) Inventor: Otto Zapf, Herzog-Adolph-Strasse 2, 61462 Konigstein (DE)

( * ) Notice: Subject to any disclaimer, the term of this patent is extended or adjusted under 35 U.S.C. 154(b) by 0 days.

(21) Appl. No.: 09/635,088

(22) Filed: Aug. 8, 2000

(51) Int. Cl.[7] ..... B60N 2/02

(52) U.S. Cl. ..... 297/354.1; 297/287; 297/286; 297/301.1

(58) Field of Search ..... 297/287, 290, 297/291, 286, 296, 299, 301.1, 307, 309, 354.1, 354.11

(56) References Cited

U.S. PATENT DOCUMENTS 2,034,412 A * 3/1936 Neutra ..... 297/287 X
5,338,094 A * 8/1994 Perry ..... 297/286 X
6,070,937 A * 6/2000 Ginat ..... 297/286 X
6,116,687 A * 9/2000 Vogtherr ..... 297/301.1 X

FOREIGN PATENT DOCUMENTS

| | | | | |
|---|---|---|---|---|
| FR | 1249297 | * | 11/1960 | ..... 297/296 |
| GB | 395757 | * | 7/1933 | ..... 297/286 |
| GB | 2110925 | * | 6/1983 | ..... 297/286 |

* cited by examiner

*Primary Examiner*—Laurie K. Cranmer
(74) *Attorney, Agent, or Firm*—Kirschstein, et al.

(57) ABSTRACT

In a chair having a pivoting backrest, displacement of a seated person's clothing is minimized by yieldably mounting a pivot axis for the backrest so that the pivot axis is lowered in elevation as the person's back leans against the backrest.

10 Claims, 2 Drawing Sheets

SEATING FURNITURE WITH DOWNWARDLY MOVABLE, PIVOTING BACKREST

BACKGROUND OF THE INVENTION

1. Field of the Invention

The present invention generally relates to seating furniture with a backrest pivotable about a generally horizontal pivot axis for supporting a seated person's lower back and, more particularly, to minimizing relative vertical movement between the seated person's back and a lower edge of the backrest, which movement tends to displace the person's clothing.

2. Description of the Related Art

It is known, for example, from my U.S. Pat. No. 5,018,791 and its equivalent German Patent No. DE 38 26 290 to support a seated person's back against a backrest pivotable about a generally horizontal, pivot axis fixed to a frame of a chair or analogous seating furniture. The backrest has two backrest portions inclined at an obtuse angle relative to each other. The pivot axis extends through the area where the inclined backrest portions meet. When the person's upper back leans downwardly and rearwardly against an upper one of the backrest portions, the lower backrest portion pivots upwardly and forwardly against, and supports, the person's lower back. For increased comfort, my aforementioned patent teaches providing greater flexibility to central areas of the upper and lower backrest portions, as well as curving said central areas.

As comfortable as the seating furniture disclosed in my aforementioned patent is, the upward, forward pivoting of the lower backrest portion causes the seated person's clothing to be displaced. For example, the back panel of the seated person's shirt or blouse can be lifted and pulled out of the back of the person's pants or skirt, especially over the course of a day where the person frequently leans back and pivots the backrest a number of times. This problem is exacerbated when the backrest is upholstered, because many types of upholstered material have a greater coefficient of friction as compared to non-upholstered backrests and, hence, the upholstered material more affirmatively grabs and lifts the back panel of the person's shirt or blouse.

SUMMARY OF THE INVENTION

Objects of the Invention

Accordingly, it is a general object of this invention to further increase the seating comfort of such furniture.

More particularly, it is an object of the present invention to minimize the tendency of such furniture to displace a seated person's clothing.

Features of the Invention

In keeping with the above objects and others which will become apparent hereafter, one feature of the present invention resides in a seating furniture, such as a chair, comprising a frame on a floor; a seat on the frame, for supporting a seated person; and a backrest for supporting a back of the seated person, the backrest being pivotable about a generally horizontal pivot axis elevated relative to the floor.

In accordance with this invention, the pivot axis is yieldably mounted for movement in which the pivot axis is lowered in elevation as the person's back leans against the backrest. This minimizes the relative vertical movement between a lower edge of the backrest and the person's back not only for greater user comfort, but also for minimizing, if not eliminating, the tendency of such furniture with a pivoting backrest to lift the back panel of one's clothing out of the back of one's pants or skirt.

In one embodiment, the frame includes a pair of armrests having movable arm sections on which the pivot axis is supported. The arm sections are made of a resilient material.

In another embodiment without armrests, the frame includes a pair of movable side supports for supporting the pivot axis and the backrest. Each side support has a vertical and a horizontal section. Each support section can be made of a resilient material. Preferably, a plurality of resilient elements such as rubber pads is used to resiliently support each horizontal section.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
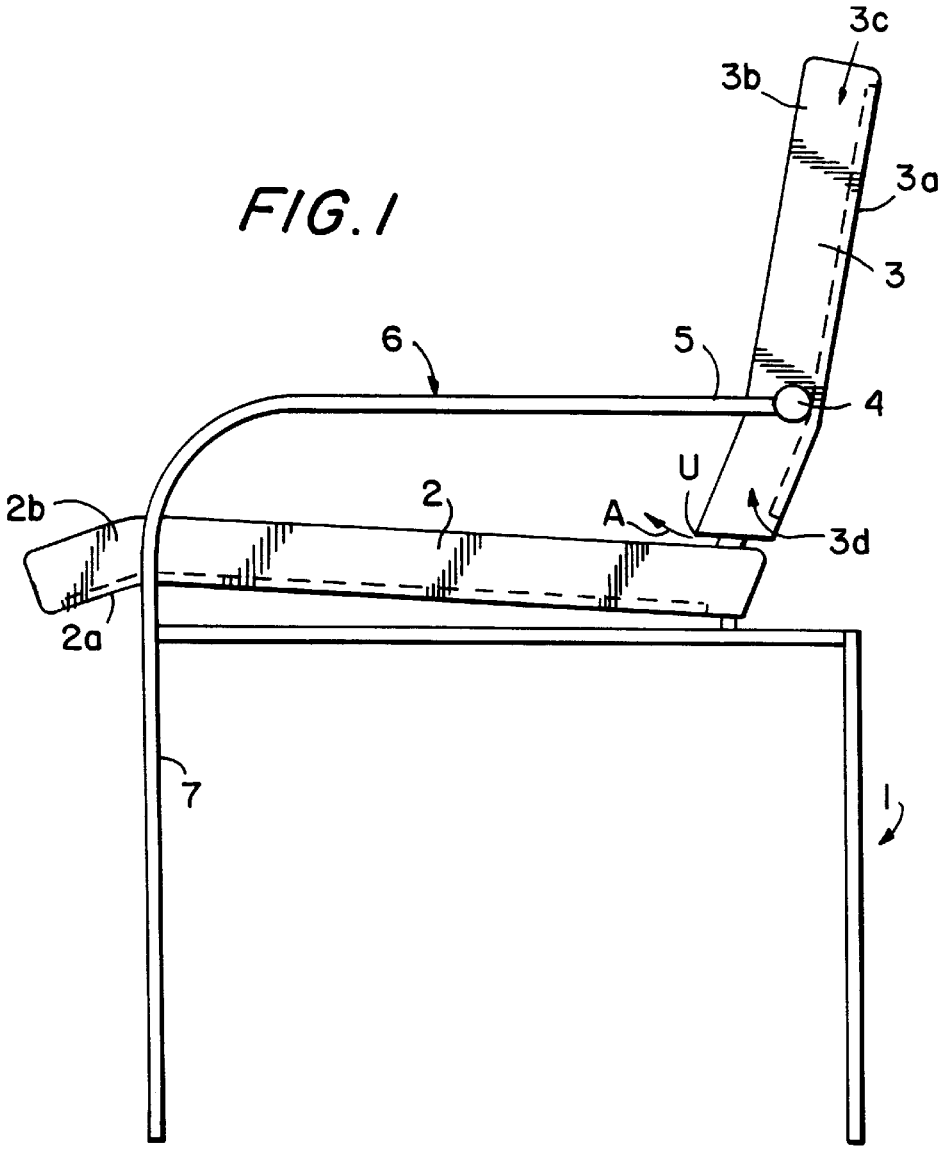
FIG. 1 is a side elevational view of one embodiment of a chair having armrests in accordance with this invention.
Figure 2:
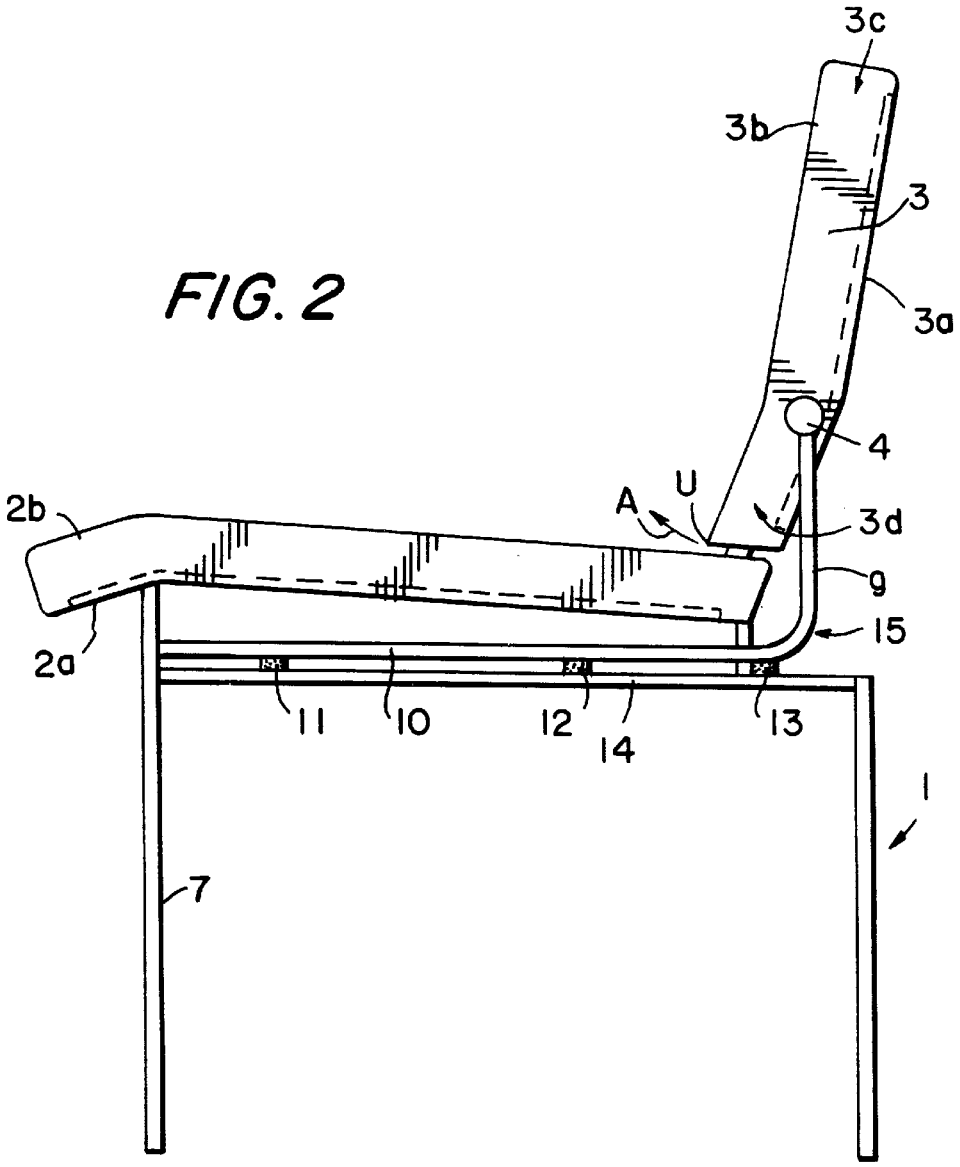
FIG. 2 is a side elevational view of another embodiment of a chair without armrests in accordance with this invention.

Referring to FIGS. 1 and 2, reference numeral 1 generally identifies a frame of an item of seating furniture, in this case, a chair. The frame 1 is preferably made of steel, aluminum, wood, plastic or like materials conventionally used in chair construction.

A seat 2 is mounted on the frame and elevated above a floor. The seat 2 is preferably fixed in position relative to the frame. The seat 2 preferably has a bottom seat plate 2*a* for rigidity, and seat upholstery 2*b* for cushioning the seat plate.

A backrest 3 is supported by the frame. The backrest 3 preferably has a rear backboard 3*a* for rigidity, and backrest upholstery 3*b* for cushioning the backboard. The backrest 3 has an upper backrest portion 3*c* inclined at an obtuse angle, preferably greater than 145°, relative to a lower backrest portion 3*d*. The backrest 3 is pivotable about a generally horizontal pivot axis 4 elevated above the floor. The pivot axis extends through the area or corner at which the inclined backrest portions meet. The pivot axis extends through the backrest, preferably forwardly of the backboard 3*a*.

In use, a seated person's back is supported by the backrest. When the person leans rearwardly, the upper backrest portion 3*a* turns clockwise, as considered in FIGS. 1 and 2, and is pushed rearwardly and downwardly. At the same time, the lower backrest portion 3*d* turns clockwise and is moved forwardly and upwardly into supporting engagement with the person's lower back, thereby providing increased seating comfort.

However, as described above, this forward and upward movement of the lower backrest portion 3*d*, as exemplified by a lower edge U on the lower backrest portion and by the arrow A, often causes the back panel of the seated person's shirt or blouse to be pulled up out from confinement in the person's pants or skirt, especially during repeated leanings of the person's back against the backrest. Hence, to minimize the vertical movement between the lower edge U and the person's back, the pivot axis 4 is yieldably mounted for movement on the furniture such that the pivot axis is lowered in elevation as the person leans rearwardly against the backrest.

As shown in FIG. 1, the frame includes a pair of armrests 6 (only one shown), each having a generally horizontal free rear end 5 for supporting the pivot axis 4. Each armrest 6 has a curved front end which merges into a respective front leg 7. The pivot axis 4 is cantilever mounted at the rear end 5 and, hence, is free to move down when the person exerts pressure on, and tilts, the backrest. Preferably, the armrests, and especially the rear ends, are constituted of a resilient material, such as tubular spring steel, to enable such downward movement, as well as the automatic return of the rear ends to their original positions at the height of the free ends 5 of the armrests.

As shown in FIG. 2, the frame has no armrests, but instead, includes a pair of side supports 15 (only one shown), each having a generally horizontal section 10 extending from a respective front leg 7 underneath the seat and generally parallel to a stationary frame platform 14, and a generally vertical section 9 extending upwardly from the respective horizontal section 10. The pivot axis 4 is cantilever mounted on the top of each vertical section 9 and, hence, is free to move down when the person leans back, and tilts, the backrest. Preferably, the side supports, and especially the horizontal sections 10, are constituted of a resilient material, such as tubular spring steel, to enable such downward movement, as well as the automatic return of the side supports to their original positions. A plurality of resilient elements, such as rubber pads 11, 12, 13, is spaced apart and between each horizontal section 10 and the platform 14 for increased resilience and automatic return of the pivot axis to its original elevation once the pressure on the backrest is released.

Figure 3:
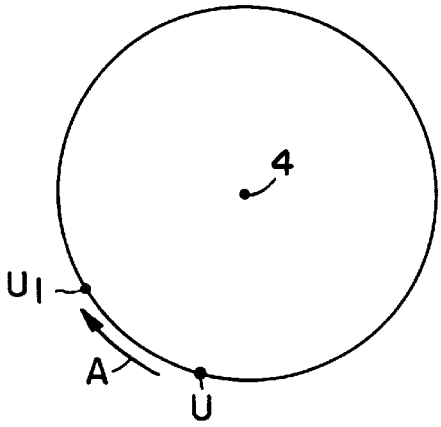
FIG. 3 PRIOR ART
FIG. 3 is a diagram depicting movement of a lower edge of a backrest in accordance with the prior art.

FIG. 3 depicts the movement of the lower edge U about a fixed pivot axis according to the prior art. The lower edge moves along a circular arc in the direction of arrow A to the position $U_1$.

Figure 4:
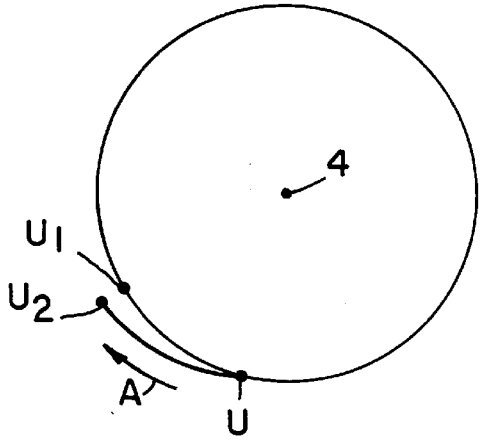
FIG. 4 is a diagram analogous to FIG. 3 but showing said movement in accordance with this invention.

FIG. 4 depicts the movement of the lower edge U about a movable pivot axis according to this invention. The pivot axis 4 is lowered in elevation so that the lower edge U does not move to position $U_1$, but instead moves to position $U_2$. Hence, there is less relative vertical movement of the lower edge U and less of a tendency for the person's clothes to be displaced during tilting of the backrest.

It is also contemplated that central areas of the upper and lower backrest portions 3*c*, 3*d* could be provided with increased flexibility as compared to outer areas of the upper and lower backrest portions. Moreover, these central areas could be curved for increased comfort.

It will be understood that each of the elements described above, or two or more together, also may find a useful application in other types of constructions differing from the types described above.

While the invention has been illustrated and described as embodied in seating furniture with downwardly movable, pivoting backrests, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

I claim:

1. Seating furniture, comprising:

a) a frame having front and rear frame portions spaced apart along a longitudinal direction, and a pair of side frame portions spaced apart along a transverse direction perpendicular to the longitudinal direction;

b) a seat mounted on the frame between the side frame portions; and c) a backrest pivotably mounted on the frame at a generally horizontal pivot axis extending along the transverse direction, the backrest including an upper backrest portion and a lower backrest portion inclined relative to each other at an obtuse angle and meeting at a corner through which the pivot axis extends, the pivot axis being elevated relative to the seat along a height direction perpendicular to the longitudinal and transverse directions, the backrest being yieldably mounted on the frame for movement between a rest position in which the lower backrest portion extends from the pivot axis forwardly along the longitudinal direction and also downwardly along the height direction, and a tilted position in which the pivot axis is lowered in elevation along the height direction and in which the lower backrest portion is pivoted about the lowered pivot axis as a back of a seated person leans against the upper backrest portion.

2. The furniture of claim 1, wherein the seat is stationarily mounted on the frame.

3. The furniture of claim 2, wherein the seat includes a bottom seat plate, and seat upholstery for cushioning the seat plate.

4. The furniture of claim 1, wherein the backrest includes a rear backboard, and backrest upholstery for cushioning the backboard.

5. The furniture of claim 4, wherein the backboard has a front surface within the backrest, and wherein the pivot axis extends through the backrest at a location forwardly of the front surface of the backboard.

6. The furniture of claim 1, wherein the frame includes a pair of armrests for supporting the person's arms, each armrest having a movable arm section on which the pivot axis is movably supported.

7. The furniture of claim 6, wherein each movable arm section has an end region at which the pivot axis is movably supported.

8. The furniture of claim 6, wherein each movable arm section is constructed of a resilient material.

9. Seating furniture, comprising:

a) a frame on a floor, the frame including a pair of movable side supports;

b) a seat on the frame, for supporting a seated person; and c) a backrest for supporting a back of the seated person, the backrest being pivotable about a generally horizontal pivot axis elevated relative to the floor, the backrest and the pivot axis being supported by the movable side supports, each side support having a generally vertical portion connected to the pivot axis, and a generally horizontal, portion connected to the frame, and the pivot axis being yieldably mounted for movement in which the pivot axis is lowered in elevation as the person's back leans against the backrest.

10. The furniture of claim 9, wherein each side support includes resilient elements for resiliently supporting a respective horizontal portion.

* * * * *